US011299313B2

(12) United States Patent
Lawrence et al.

(10) Patent No.: US 11,299,313 B2
(45) **Date of Patent: *Apr. 12, 2022**

(54) STACKABLE CORRUGATED SHIPPING AND DISPLAY CONTAINER AND METHOD OF MAKING SAME

(71) Applicant: The Hershey Company, Hershey, PA (US)

(72) Inventors: Eric Lawrence, Hershey, PA (US); Katelyn R. Rocheleau, Harrisburg, PA (US); Gregory Gressel, Hershey, PA (US)

(73) Assignee: The Hershey Company, Hershey, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/674,851

(22) Filed: Nov. 5, 2019

(65) Prior Publication Data

US 2021/0130033 A1 May 6, 2021

(51) Int. Cl.

| | |
|---|---|
| ***B65D 5/02*** | (2006.01) |
| ***B65D 5/00*** | (2006.01) |
| ***B65D 5/42*** | (2006.01) |
| ***B31B 50/74*** | (2017.01) |
| ***B31B 50/25*** | (2017.01) |
| ***B31B 50/26*** | (2017.01) |
| ***B31B 50/62*** | (2017.01) |
| ***B31B 50/73*** | (2017.01) |
| ***B31B 50/06*** | (2017.01) |

(52) U.S. Cl.

CPC ..... *B65D 5/0227* (2013.01); *B31B 50/06* (2017.08); *B31B 50/25* (2017.08); *B31B 50/26* (2017.08); *B31B 50/62* (2017.08); *B31B 50/732* (2017.08); *B31B 50/74* (2017.08); *B65D 5/001* (2013.01); *B65D 5/4204* (2013.01); *B65D 5/4266* (2013.01)

(58) Field of Classification Search

CPC .... B65D 5/5405; B65D 5/0227; B65D 5/445; B65D 5/001; B65D 5/16; B65D 5/0281; B65D 5/3621; B65D 5/5213; B65D 5/4204; A47F 5/11

USPC ..... 229/240, 122.32, 166, 185.1, 103, 919; 206/750, 774; 221/305; 312/259

See application file for complete search history.

(56) References Cited

U.S. PATENT DOCUMENTS 3,955,747 A * 5/1976 Bell ..... B65D 5/4208 229/117.12
4,804,138 A * 2/1989 McFarland ..... B65D 5/4208 229/117.12

(Continued)

*Primary Examiner* — Christopher R Demeree
(74) *Attorney, Agent, or Firm* — Jordan IP Law, LLC

(57) ABSTRACT

The present disclosure relates to a shipping and display container which can be formed from one or more blanks folded and formed according to a method for creating the container. A portion of the blank forming the front wall can be formed from two stacked, joined layers including an interior and an exterior blank layer. The exterior blank layer includes top flaps and bottom flaps, the top flaps being significantly smaller in height compared to the bottom flaps such that when the container is formed, the top flaps form a bearing surface along the border of the container, on which a second container may be stacked, while defining a central window that displays the interior contents of the container.

20 Claims, 12 Drawing Sheets

(56) References Cited

U.S. PATENT DOCUMENTS

| | | | | |
|---|---|---|---|---|
| 5,715,993 | A * | 2/1998 | Pareike | B65D 5/5445 229/122.34 |
| 10,472,123 | B2 * | 11/2019 | Little | B65D 5/4279 |
| 2004/0060974 | A1 * | 4/2004 | Dacey | B65D 5/543 229/225 |

* cited by examiner

KEY:
score
cut
perforation
axis

STACKABLE CORRUGATED SHIPPING AND DISPLAY CONTAINER AND METHOD OF MAKING SAME

BACKGROUND

The present disclosure relates to stackable packaging containers which are effective for shipping goods to a point of sale and for being easily and reliably converted into a merchandise display case after delivery.

Containers made of corrugated fiberboard are in widespread use for shipping and selling goods. Flat sheets of corrugated fiberboard, referred to as blanks, are typically used as starting material to form corrugated containers such as boxes. One or more blanks may be cut to a desired shape, having a plurality of sections that will form side panels, end panels, top flaps, bottom sections, and other components of a box. The panels are generally defined by scored, perforated, slotted or cut lines in locations which form joints where the blank is folded into an assembled box. Some sections of a blank may be attached to other sections by adhering means, for example, glue or double-sided tape.

There is an increasing demand for multipurpose shipping containers that can be quickly and efficiently converted into display cases. Such containers minimize the amount of container material while maximizing the display space available. They also minimize the amount of time and labor a retail establishment must provide to display goods for sale.

In order to be economically viable, the containers must be capable of being shipped in flattened form to the location where the goods will be packaged, then assembled, or erected, into box form. The flattened forms are known in the industry as knocked down flats (KDFs) or pre-assemblies, because the flattened forms have panels which are glued or otherwise joined together, such that the box is in a pre-assembled state. Assembling or erecting the boxes requires that panels be squared up, flaps folded, and typically tape applied one or more flaps to maintain the box in an assembled state. It is desirable to use as little corrugated material as needed to deliver a box with the required strength that is easily assembled into box form.

A blank or blanks constructed from a material which may be easily cut, scored and folded, such as corrugated fiberboard, may be configured into pre-assembled boxes (KDFs). These flattened forms may have members or panels which have been affixed to one another but not finally erected or assembled into a box. Thus, the KDFs may be shipped more efficiently in flattened form and subsequently erected or assembled into boxes when a shipping container is required. The filled boxes may then be shipped to a point of sale where they are converted into a display case by removing a window panel which has been designed to tear away from the box.

Once the boxes are formed and filled, they are typically sealed by sequentially folding and overlapping the top and bottom panels and securing them with adhering means, for example, tape. Standard shipping practices call for filled boxes to be stacked into pallet loads requiring the boxes to be strong enough to be stacked in multiple layers when filled with goods.

Constructing containers that are constructed to be in a knock-down flat configuration when not filled with product typically requires a relatively complex blank and a relatively complex assembly process—typically requiring manual labor, which results in relatively high manufacturing costs.

Upon delivery to a retail establishment, it is desirable that the boxes be easily and reliably converted into attractive display cases, preferably without the need for cutting tools which create a workplace safety hazard and risk of damage to the goods. A removable (or tear away) window is one means of providing such conversion. In prior container designs, however, tear away windows frequently do not open quickly or easily to form display cases, or they may do so in a way that rips the corrugated material or leaves jagged openings which create unattractive displays. In addition, many removable windows of prior designs are also susceptible to being prematurely separated from the box.

It is also desirable for such boxes to be stacked when on display in order to optimize floor or shelf space. Many conventional containers do not have sufficient strength to support the weight of goods and containers. This either limits the height of displays and/or results in a damaged or unattractive display.

Prior designs for multipurpose shipping boxes which convert into display cases suffer from a number of other disadvantages. They may be labor intensive or expensive to manufacture and assemble. They may require excessive materials or elaborate construction to meet the need for strength and the ability to open into a display case. Some designs may require retail employees to use cutting tools to open the boxes, creating the risk of workplace injury or damage to products inside the boxes.

U.S. patent application Ser. No. 16/067,979 to Gressel et al. (Pub. No. US 2019/0023451 A1), whose disclosure is incorporated by reference herein in its entirety, discloses a shipping and display container made from a blank having an interior portion and an exterior portion. The container provides a strong supportive structure that enables it to support the weight of other such containers, thereby allowing such containers to be stacked. However, this container also includes a removable portion that must be removed in order to reveal the contents therein when the container is put on display. This creates unnecessary waste, as a user must then discard the removable portion separately from the container.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments, as described below and as defined by the claims which follow, include improvements to the structure and methods of making a container that is designed to be converted into a display. Several specific aspects of the apparatus and methods of the present invention are outlined below.

Aspect 1: A corrugated fiberboard blank, including:

an outer portion including an outer front panel having a first side edge and a second side edge, an outer first side panel located adjacent to the first side edge of the outer front panel and having a front edge and a back edge, an outer second side panel located adjacent to the second side edge of the outer front panel and having a front edge and a back edge, an outer first back panel located adjacent to the back edge of the outer first side panel, and an outer second back panel located adjacent to the back edge of the outer second side panel, the outer front panel, the outer first side panel, the outer second side panel, and at least one of the outer first back panel and the outer second back panel forming an enclosed perimeter wall, the outer front panel including a lower portion and an upper portion, the lower portion having an upper border that defines a display window of the front panel, and the upper portion being connected to the lower portion along a portion of the upper border;

an inner portion including an inner front panel having a first side edge and a second side edge, an inner first side panel adjacent to the first side edge of the inner front panel and having a front edge and a back edge, an inner second side panel adjacent to the second side edge of the inner front panel and having a front edge and a back edge, an inner first back panel adjacent to the back edge of the inner first side panel, and an inner second back panel adjacent to the back edge of the inner second side panel;

a first side top flap extending from an upper edge of the outer first side panel, a second side top flap extending from an upper edge of the outer second side panel, a first back top flap extending from an upper edge of the first outer back panel, and a second back top flap extending from an upper edge of the second outer back panel; and a front bottom flap extending from a bottom edge of the outer front panel, a first side bottom flap extending from a bottom edge of the outer first side panel, a second side bottom flap extending from a lower edge of the outer second side panel, a first back bottom flap extending from a bottom edge of the outer first back panel, and a second back bottom flap extending from a bottom edge of the outer second back panel;

wherein each of the first and second side top flaps and first and second back top flaps has a top flap height and each of the front bottom flap, first and second side bottom flaps, and first and second back bottom flaps has a bottom flap height, the top flap height being less than half of the bottom flap height.

Aspect 2: A method of forming a container, including:

(a) providing an outer portion including an outer front panel, an outer first side panel located adjacent to a first edge of the outer front panel, an outer second side panel located adjacent to a second edge of the outer front panel, and at least one outer back panel located adjacent to the back edge of one of the outer first side panel and outer second side panel;

(b) providing an inner portion including an inner front panel, an inner first side panel located adjacent to a first side edge of the inner front panel, an inner second side panel located adjacent to a second side edge of the inner front panel, an inner first back panel adjacent to a back edge of the inner first side panel, and an inner second back panel adjacent to a back edge of the inner second side panel;

(c) providing a first side top flap extending from an upper edge of the outer first side panel, a second side top flap extending from an upper edge of the outer second side panel, and at least one back top flap extending from an upper edge of the at least one outer back panel; and (d) providing a front bottom flap extending from a bottom edge of the outer front panel, a first side bottom flap extending from a bottom edge of the outer first side panel, a second side bottom flap extending from a lower edge of the outer second side panel, and at least one back bottom flap extending from a bottom edge of the at least one outer back panel;

(e) positioning the inner portion atop the outer portion;

(f) affixing the inner front panel to an inner side of the outer front panel in the position of step (e);

(g) affixing the inner first back panel and the inner second back panel to an inner side of the at least one outer back panel in a location that results in the inner first side panel extending from the inner front panel to the inner first back panel in a spaced-apart relationship to the outer first side panel and the inner second side panel extending from the inner front panel to the inner second back panel in a spaced-apart relationship to the outer second side panel;

(h) forming an enclosed perimeter wall including the outer front panel, the outer first side panel, the outer second side panel, and the at least one outer back panel;

(i) forming a substantially enclosed bottom surface from the front bottom flap, the first side bottom flap, the second side bottom flap, and the at least one back bottom flap; and (j) forming a load bearing top surface from the first side top flap, the second side top flap, and the at least one back top flap, the top surface defining a window through which an interior of the container can be viewed.

BRIEF DESCRIPTION OF THE DRAWINGS

For a more complete understanding of the present invention, reference is made to the following detailed description of an embodiment considered in conjunction with the accompanying drawings, in which.

DETAILED DESCRIPTION OF THE INVENTION

Figure 1:
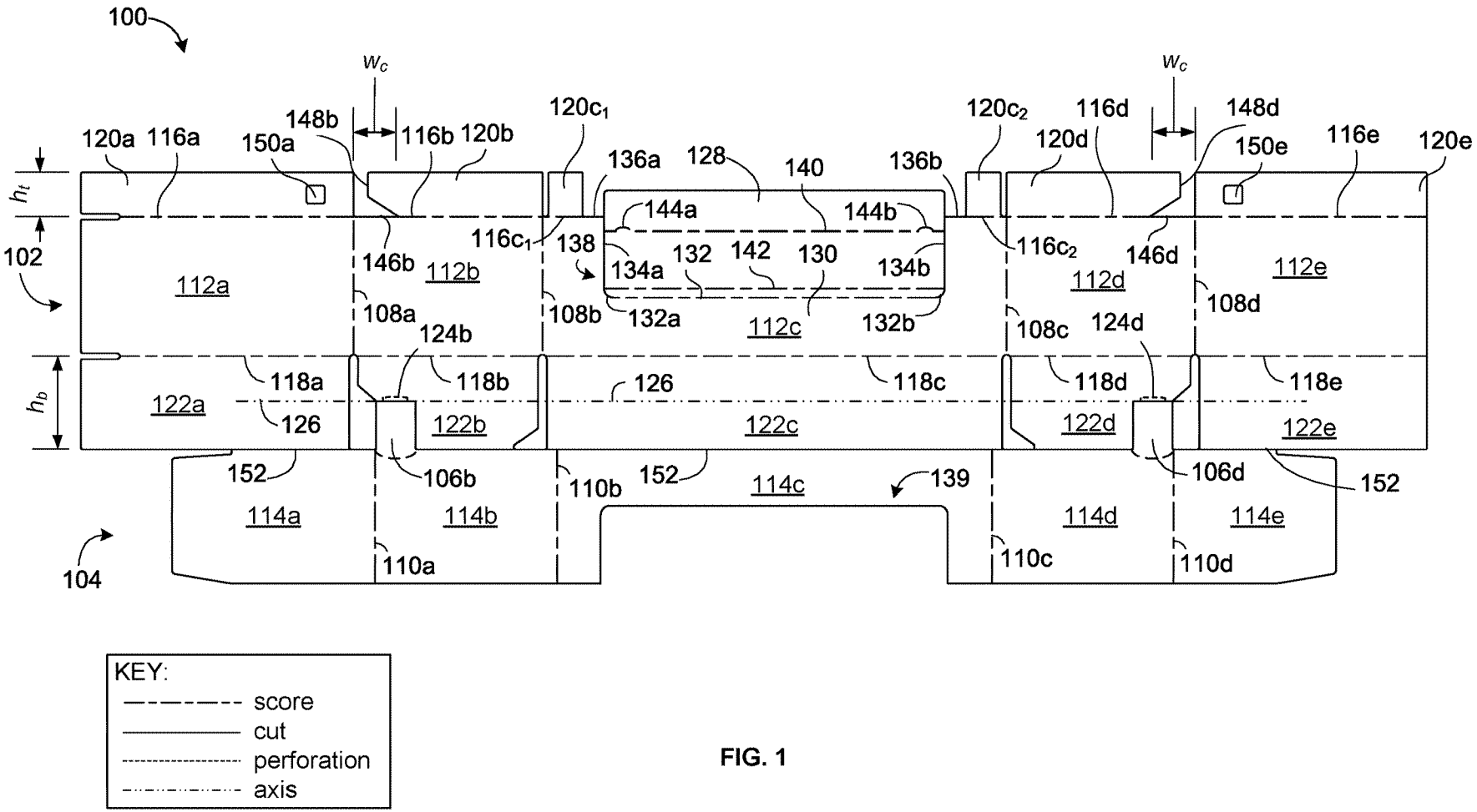
FIG. 1 is a plan view of a unitary blank constructed in accordance with one or more embodiments.

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign particular meaning. Further, it should be noted that, as recited in the specification and in the claims appended hereto, the singular forms "a," "an," and "the" include the plural referents unless otherwise stated. Additionally, the terms "comprises" and "comprising" when used herein specify that certain features are present in that embodiment but should not be interpreted to preclude the presence or addition of additional features, components, operations, and/or groups thereof.

The following disclosure is intended to be read in connection with the accompanying drawings, which are to be considered part of the entire written description of the invention. The drawing figures are not necessarily to scale, and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

The present disclosure relates to a multipurpose box designed for storing, shipping and displaying items offered for sale in retail stores. The box is strong, cost effective to manufacture, stackable, and easily and reliably convertible into a retail display. The box may be constructed from one or more corrugated fiberboard blanks or other similar material. The blanks and/or KDFs and/or containers of the embodiments and configurations described herein are typically manufactured using corrugated fiberboard, for example. It is to be understood that the principles in one or more of the embodiments and/or configurations of this disclosure may be made to containers made of other materials, shapes or styles.

As used herein, the terms "adhered" or "affixed" (and other formatives of these terms) are intended to mean that one surface is attached to another using an adhesive, such as glue, tape, cement, or paste. The adhesive may be placed on either one or both of the surfaces being adhered. Adhesive materials are represented in the drawings as "X"s or striped tape.

As used herein, the term "blank" means a planar piece of material that has been cut into a shape that is then used to create a container.

As used herein, a "unitary blank" means a blank that consists of single sheet of material, for example corrugated fiberboard, at the start of assembly process. In the case of a multi-layer box (such as those disclosed in this application), all of the layers are included in the unitary blank and none of the layers that form part of the finished box are separated from each other before being positioned and affixed to each other.

As used herein, the terms "cut" and "cut line" mean a continuous incision in the material which penetrates the entire thickness of the material.

As used herein, the term "perforation" means an alternating pattern of cuts and connected portions in the material. As used herein, the term "nick" means a portion of material, preferably between 1/32 and 1/8 inch in width, which connects two adjacent portions of a material and is located along a line along which the two pieces of material are cut apart. A "nick" is distinguished from a perforation in that each nick is located along a line or curve in which the materials are separated by cut portions on either side of the nick and the cut portions are preferably at least five times (more preferably, at least ten times) the width of each nick. Perforations are characterized by alternating connected and cut portions which are much more proportional in size (typically a width difference of no more than 2-3 times between connected portions and cut portions). A nick can be formed by grinding away a small portion of the cutting die knife rule.

As used herein, the terms "score" and "score line" mean a crease or shallow cut that does not fully penetrate the entire thickness of the material which serves to make folding the material easier along the score line than along an unscored line. The score acts as a joint in the material, along which portions of the material may be more easily folded.

As used herein, the term "separation line" means a line or curve formed of any combination of cut, nicked, and perforated portions that defines a border between two adjacent, connected elements. The weakened connection provided by the separation line enables the elements adjacent to the separation line to be more easily and predictably separated along the separation line than if the separation line were not present.

As used herein, the term "corrugated" means a material consisting primary of a fluted corrugated sheet and at least one flat linerboard.

FIG. 1 illustrates a blank 100 for forming a container in accordance with an embodiment of the present invention. The blank 100 is made from a corrugated material, such as fiberboard, and includes a pattern of panels, flaps, cuts, perforations, nicks and scores which enable the blank 100 to be folded into a KDF and subsequently assembled into a box. In this embodiment, blank 100 is a single, unitary blank that includes an outer portion 102 and an inner portion 104 which are joined together at first and second connection tabs 106*b*, 106*d*. As explained in greater detail below, the inner portion 104 is contained within the outer portion 102 when the blank 100 is fully assembled into a box.

In one embodiment, the blank 100 is scored along outer panel fold joints 108*a-d* and inner panel fold joints 110*a-d* to form outer and inner first back panels 112*a*, 114*a*, outer and inner first side panels 112*b*, 114*b*, outer and inner front panels 112*c*, 114*c*, outer and inner second side panels 112*d*, 114*d*, and outer and inner second back panels 112*e*, 114*e*. The outer portion 102 of the blank 100 is also scored along top flap fold joint 116 and bottom flap fold joint 118 to form first back top and bottom flaps 120*a*, 122*a*, first side top and bottom flaps 120*b*, 122*b*, first and second support tabs $\mathbf{120}c_1$,

120$c_2$, front bottom flap 122*c*, second side top and bottom flaps 120*d*, 122*d*, and second back top and bottom flaps 120*e*, 122*e*.

The scored fold lines serve as joints such that adjacent panels and flaps of the blank may be folded along the scored lines such that a substantially right angle exists at each joint. Some structural features may utilize joints forming angles which are not substantially right angles. Joints and other features of the box may alternatively make use of cuts, nicks and perforations in the blank. It should be noted that, in order to comply with the limitations of black and white formal patent drawings, the symbols used in the drawings to identify scores, cuts, nicks, and perforations are different that those typically used in technical drawings in the art.

Each panel and flap of the blank 100 has an inside and outside surface. When the box is assembled, the inner portion 104 is generally contained within the outer portion 102. Unless otherwise specified herein "inner" and "outer" refer to the relative position of blanks, panels and other features when the box is fully assembled and erected.

As seen in FIG. 1, the outer panels of the outer portion 102 are arranged in a generally linear arrangement such that the uppermost and lowermost edges of all the outer panels, which are represented by the top flap fold joint 116 and bottom flap fold joint 118, respectively, are colinearly aligned. The outer front panel 112*c* is centrally located in the outer portion 102, and the outer first side panel 112*b* and the outer second side panel 112*d* are joined to the outer front panel 112*c* on either side thereof along outer panel fold joints 108*b* and 108*c*, respectively. The outer first back panel 112*a* is joined to the outer first side panel 112*b* at outer panel fold joint 108*a*, and the outer second back panel 112*e* is joined to the outer second side panel 112*d* at outer panel fold joint 108*d*. When the blank 100 is assembled into a KDF, the outer first back panel 112*a* and outer second back panel 112*e* are affixed to one another to collectively form a back panel. In addition, the outer first back panel 112*a*, the outer first side panel 112*b*, the outer front panel 112*c*, the outer second side panel 112*d*, and the outer second back panel 112*e* collectively form an enclosed perimeter wall when the blank 100 is fully constructed into a container.

The outer portion 102 also includes top flaps extending upwardly from the upper edges of the outer panels. More particularly, a first side top flap 120*b* extends upwardly from the outer first side panel 112*b* along first side top flap fold joint 116*b*, and a second side top flap 120*d* extends upwardly from the outer second side panel 112*d* along second side top flap fold joint 116*d*. A first back top flap 120*a* extends upwardly from the outer first back panel 112*a* along first back top flap fold joint 116*a*, and a second back top flap 120*e* extends upwardly from the outer second back panel 112*e* along second back top flap fold joint 116*e*. The blank 100 also includes two support tabs (i.e., first support tab 120$c_1$ and second support tab 120$c_2$) extending upwardly from first and second top tab fold joints 116$c_1$ and 116$c_2$ and are located proximate to the first side top flap 120*b* and the second side top flap 120*d*, respectively. The function of the first and second support tabs 120$c_1$, 120$c_2$ will be explained in further detail below.

Similarly, the outer portion 102 includes bottom flaps extending downwardly from the lower edges of the outer panels. More particularly, a first side bottom flap 122*b* extends downwardly from the outer first side panel 112*b* along first side bottom flap fold joint 118*b*, and a second side bottom flap 122*d* extends downwardly from the outer second side panel 112*d* along second side bottom flap fold joint 118*d*. A first back bottom flap 122*a* extends downwardly from the outer first back panel 112*a* along first back bottom flap fold joint 118*a*, and a second back bottom flap 122*e* extends downwardly from the outer second back panel 110*e* along second back bottom flap fold joint 118*e*. The blank 100 also includes a front bottom flap 122*c* extending downwardly from the outer front panel 112*c* along front bottom flap fold joint 118*c*.

When the container is fully assembled, the first back bottom flap 122*a* and the second back bottom flap 122*e* collectively form the back bottom flap. In addition, the front bottom flap 122*c*, the bottom first side flap 122*b*, the second side bottom flap 122*d*, the first back bottom flap 122*a*, and the second back bottom flap 122*e* (hereinafter "the bottom flaps") are sized and shaped to form the bottom of the container and provide a substantially enclosed bottom surface when all are folded inwardly and secured in the folded position.

Likewise, when the container is fully assembled, the first back top flap 120*a* and the second back top flap 120*e* collectively form the back top flap. In addition, the first and second support tabs 120$c_1$, 120$c_2$, the first side top flap 120*b*, the second side top flap 120*d*, the first back top flap 120*a*, and the second back top flap 120*e* (hereinafter "the top flaps") are sized and shaped to form the top of the container.

However, unlike the bottom flaps, the top flaps of the blank 100 are not sized to provide a substantially enclosed top surface when folded inwardly. Rather, the top flaps of the blank 100 are cut to be much shorter than the bottom flaps of the blank 100 such that when the top flaps are folded inwardly and secured in their folded position, they create a border that provides a bearing surface on which a container may rest while leaving a significant opening in the top of the container (see FIG. 11), enabling the interior of the container to be accessed by a user. In one embodiment, the height $h_t$ of the top flaps of the blank 100 are less than three quarters of the height $h_b$ of the bottom flaps of the blank 100 (see FIG. 1). In another embodiment, the height $h_t$ of the top flaps 120*a-e* of the blank 100 is less than half of the height $h_b$ of the bottom flaps 122*a-e* of the blank 100. This "tray" configuration with shorter top flaps 120*a-e* in the blank 100 reduces the material cost of making the blank 100 and the complexity of constructing the blank 100 into a container, which reduces labor costs.

As seen in FIG. 1, the inner panels of the inner portion 104 are arranged in a generally linear arrangement such that the uppermost and lowermost edges of all the inner panels are colinearly aligned. The inner front panel 114*c* is centrally located in the inner portion 104, and the inner first side panel 114*b* and the inner second side panel 114*d* are joined to the inner front panel 114*c* on either side thereof along inner panel fold joints 110*b* and 110*c*, respectively. The inner first back panel 114*a* is joined to the inner first side panel 114*b* at inner panel fold joint 110*a*, and the inner second back panel 114*e* is joined to the inner second side panel 114*d* at inner panel fold joint 110*d*.

The first connection tab 106*b* is contained within the first side bottom flap 122*b* and connects an upper edge of the inner first side panel 114*b* to the first side bottom flap 122*b* along a first pivot joint 124*b*. Similarly, the second connection tab 106*d* is contained within the second side bottom flap 122*d* and connects an upper edge of the inner second side panel 114*d* to the second side bottom flap 122*d* along a second pivot joint 124*d*. As will be described herein, the first and second pivot joints 124*b*, 124*d* define a pivot axis 126, about which the inner portion 104 is folded as part of the assembly of the blank 100 into a knock down flat.

The outer front panel 112*c* includes an upper portion 128 and a lower portion 130, where the upper portion 128 is connected to the lower portion 130 by a front panel fold joint 132. The lower portion 130 is separated from the upper portion 128 along a first vertical border edge 134*a* and a second vertical border edge 134*b*. The first vertical border edge 134*a* extends upwardly from a first end 132*a* of the front panel fold joint 132 to a first shoulder edge 136*a*, which extends laterally from the first vertical border edge 134*a* toward the first top tab fold joint 116$c_1$. Similarly, the second vertical border edge 134*b* extends upwardly from a second end 132*b* of the front panel fold joint 132 to a second shoulder edge 136*b* and then laterally toward the second top tab fold joint 116$c_2$. When the blank 100 is constructed into a box, the upper portion 128 of the front panel 112*c* folds inwardly toward the center of the box to create a window that is defined by an outer window border 138 comprising the first and second top tab fold joints 116$c_1$, 116$c_2$, the first and second shoulder edges 136*a*, 136*b*, the first and second vertical border edges 134*a*, 134*b*, and the front panel fold joint 132.

The upper portion 128 also includes a top section 128*a*, a middle section 128*b*, and a bottom section 128*c*. The top and middle sections 128*a*, 128*b* are separated by an upper fold joint 140, and the middle and bottom sections 128*b*, 128*c* are separated by a lower fold joint 142. The upper and lower fold joints 140, 142 aid the upper portion 128 in folding inwardly when the box is fully assembled, as will be discussed in greater detail below. The upper fold joint 140 also defines first and second fold-over tabs 144*a*, 144*b* which assist in securing the upper portion 128 in a folded-over position when the box is fully assembled (see FIG. 11).

In one embodiment, the first and second side top flaps 120*b*, 120*d* include first and second cutaway portions 146*b*, 146*d* in their lower back side corners proximate to the first and second back top flaps 220*a*, 220*e*, respectively. These cutaway portions 146*b*, 146*d* form triangle shaped cutouts extend into the first and second side top flaps 120*b*, 120*d* partially laterally along the back-side edge thereof and partially laterally along the top flap fold joints 116*b*, 116*d*, with the leftover portions of the first and second side top flaps 220*b*, 220*d* defining first and second tuck flaps 148*b*, 148*d*. When the blank 100 is constructed into a container, the cutaway portions 146*b*, 146*d* allow the first and second back top flaps 120*a*, 120*e* to each be the sole layer of vertical support along the top edge of the corresponding outer first and second side panels 112*b*, 112*d* proximate to the back corners of the container. This helps provide even support at the back corners for a container stacked upon a container made from the blank 100, as will be discussed in detail below. In one embodiment, the widest portion of each of the cutaway portions 146*b*, 146*d* proximate to the respective top flap fold joints 116*b*, 116*d* has a width $w_c$ that is greater than or equal to the height $h_t$ of the first and second back top flaps 120*a*, 120*b*.

In addition, first and second tuck slots 150*a*, 150*e* are formed in the first and second back top flaps 120*a*, 120*e*, respectively, proximate to the first and second tuck flaps 148*b*, 148*d*. The first and second tuck flaps 148*b*, 148*d* interface with the first and second tuck slots 150*a*, 150*e* when the blank 100 is constructed into a container, as will be discussed in further detail below.

Figure 2:
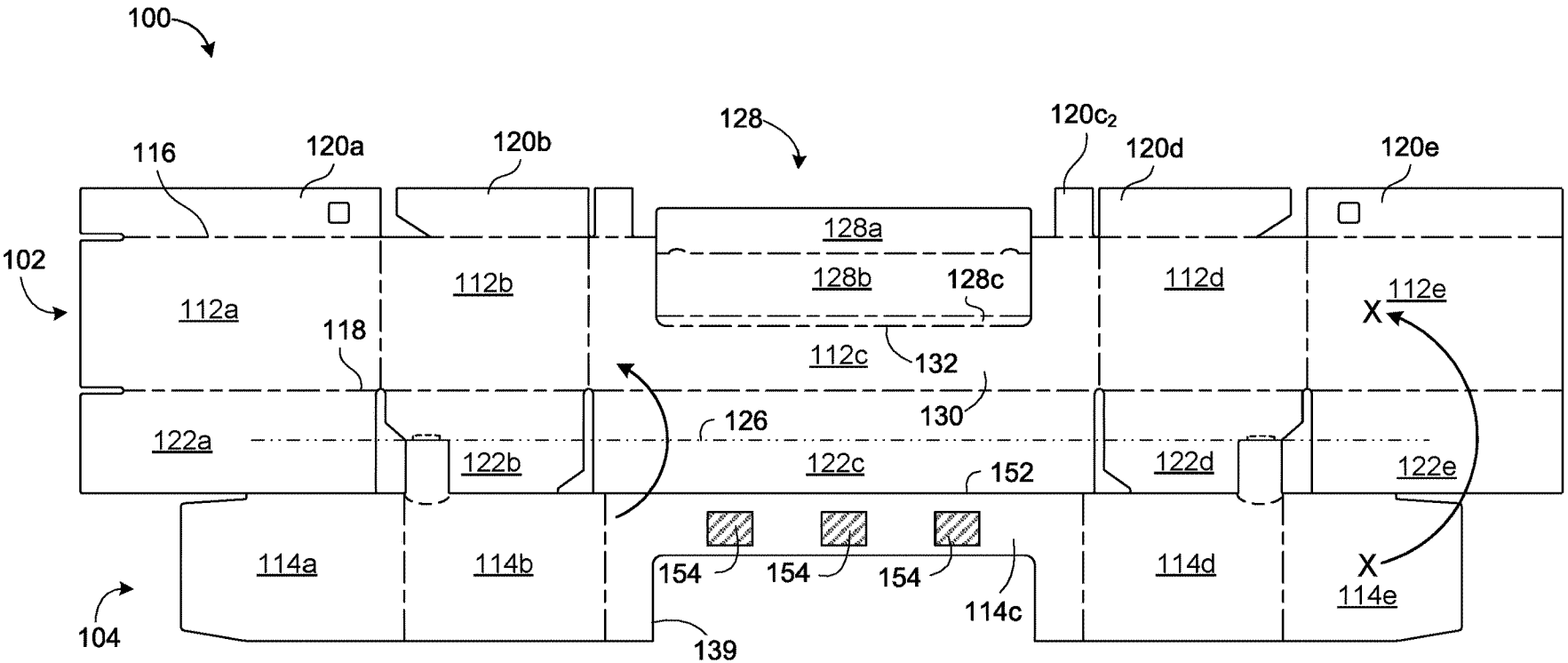
FIG. 2 is a top plan view of the blank of FIG. 1 shown with adhesive applied to the inner front panel and showing the axis along about which the inner portion is rotated in order to position it atop the outer portion.
Figure 3:
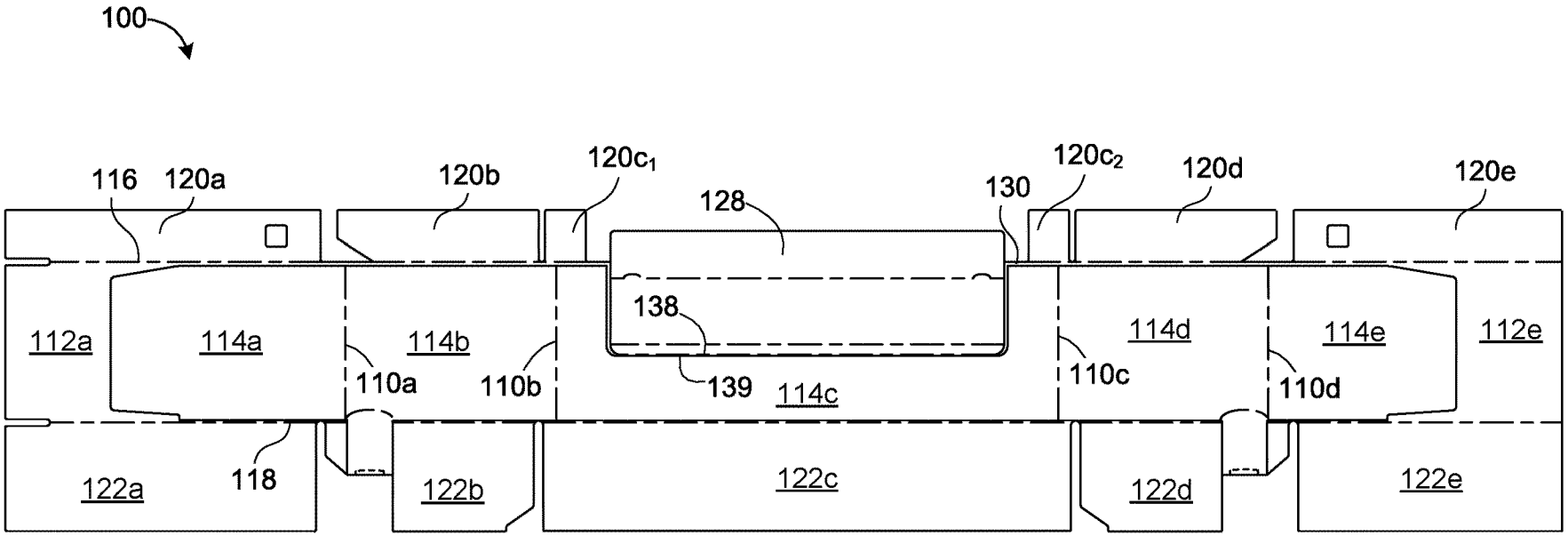
FIG. 3 is a top plan view of the blank of FIG. 1, shown with the inner portion folded and positioned atop the outer portion.

FIGS. 2 through 9 show steps in the method by which the blank 100 is assembled into a KDF. Referring to FIG. 2, the outer portion 102 is separated from the inner portion 104 by a cut line 152 extending across a width of the blank 100, except where the first and second connection tabs 106*b*, 106*d* connect to the inner portion 104. As described above, the first and second pivot joints 124*b*, 124*d* define the pivot axis 126, about which the inner portion 104 is folded. As indicated by the curved arrows in FIG. 2, showing the direction of rotation of the inner portion 104, the inner portion 104 is folded along the pivot axis 126 such that the inner portion 104 is positioned atop and properly aligned with the outer portion 102. FIG. 3 illustrates the result of such folding.

The first and second connection tabs 106*b*, 106*d* allow the inner portion 104 to be rotated in a manner that is predictable but offset from the cut line 152 separating the outer portion 102 from the inner portion 104. This offset folding arrangement allows both the outer portion 102 from the inner portion 104 to be formed from a single, unitary blank, which significantly simplifies the manufacturing and assembly of the blank to provide a box blank having two layers stacked on each other without incurring the additional costs of manufacturing and assembling two separate blanks.

An adhesive, such as glue or strips of double-sided tape 154 is applied to the inner front panel 114*c* so that the inner front panel 114*c* becomes affixed to the outer front panel 112*c* when folded over. It is preferable that any tape strips not cross the inner window border 139, so as to not impede the folding of the upper portion 128 of the outer front panel 112*c* about the front panel fold joint 132.

FIG. 3 shows the blank 100 with the inner portion 104 folded over the outer portion 102. The inner portion 104 is preferably aligned with the outer portion 102 so that the inner portion 104 is parallel to the outer portion 102 and the inner portion 104 is preferably positioned between the top and bottom flap fold joints 116 and 118. Moreover, the inner window border 139 of the inner portion 104 is preferably positioned below the outer window border 138. More preferably, the inner window border 139 of the inner portion 104 is preferably positioned below the outer window border 138 by a distance equal to one to three times (most preferably about one times) the thickness of the outer portion 102. This offset enables the first and second side top flaps 120*b*, 120*d* and the first and second support tabs 120$c_1$, 120$c_2$ to sit lower when folded inwardly, providing a flatter top surface for the container and provide improved strength characteristics for the fully assembled container.

Figure 4:
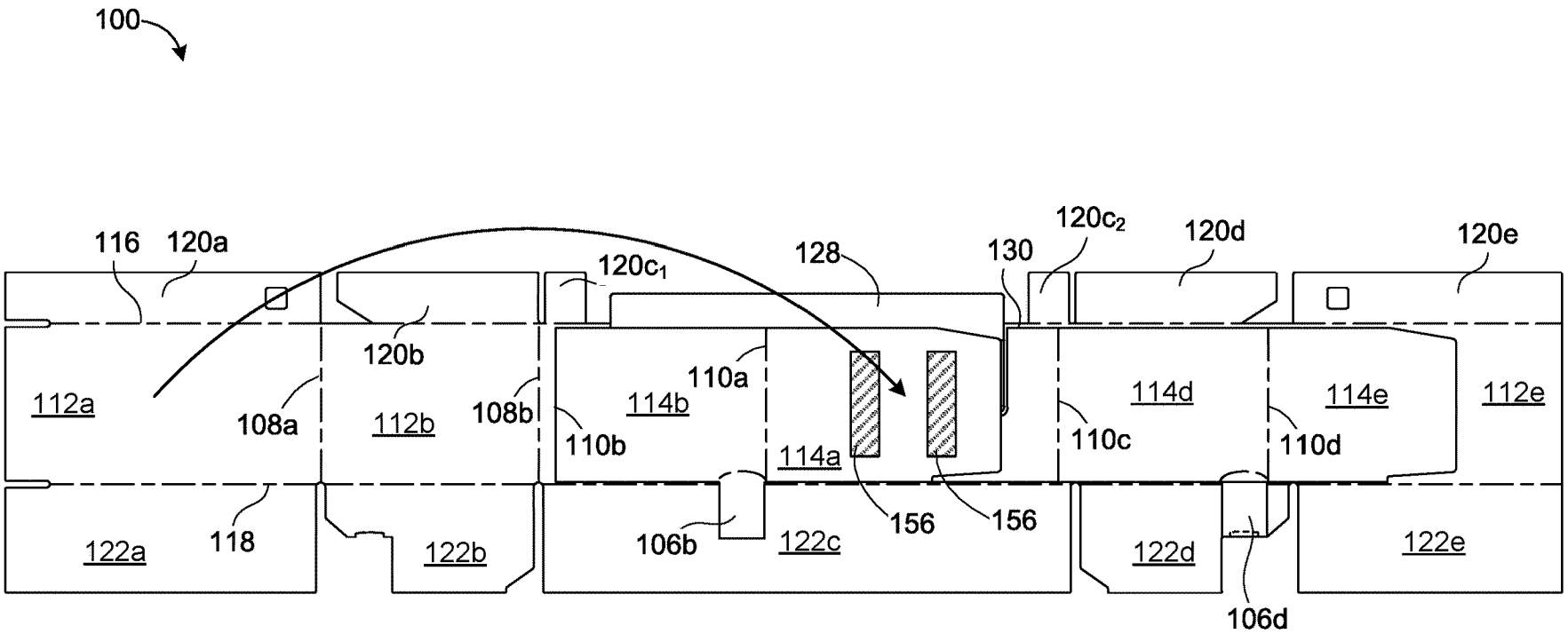
FIG. 4 is a top plan view of the blank of FIG. 1, shown with the inner first back panel and the inner first side panel folded inwardly along a fold joint between the inner first side panel and the inner front panel.
Figure 5:
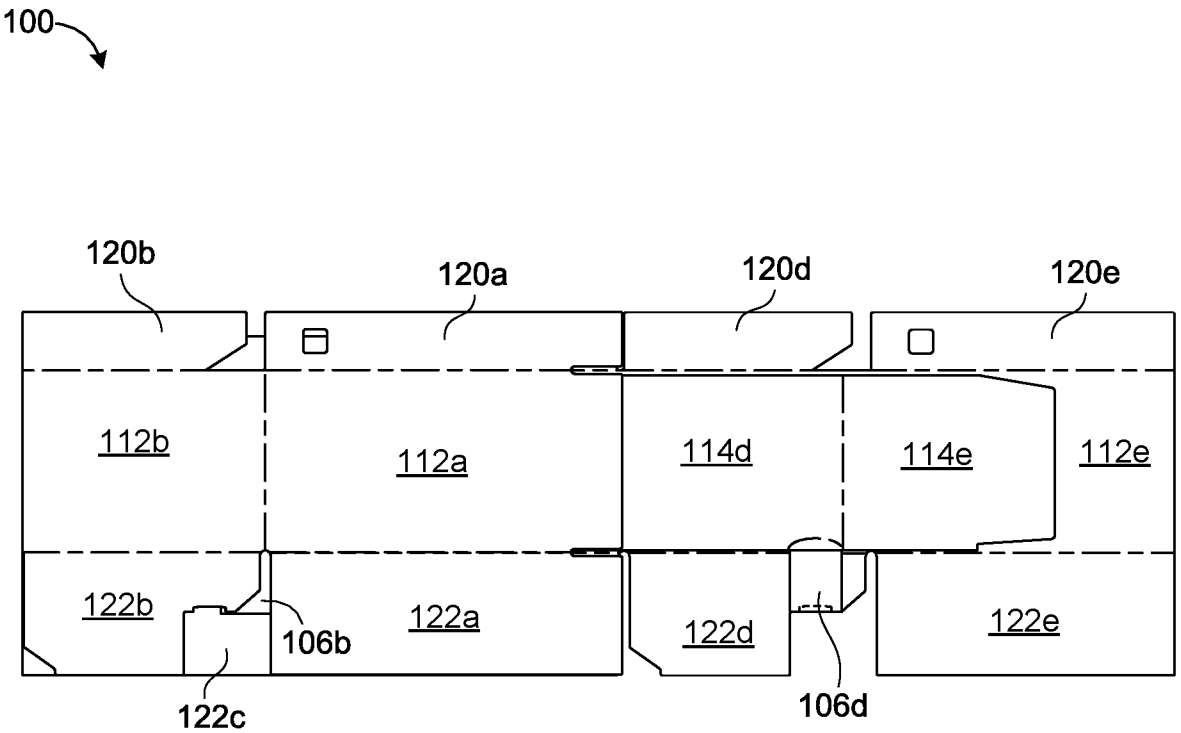
FIG. 5 is a top plan view of the blank of FIG. 1, shown with the outer first back panel and the outer first side panel folded inwardly along a fold joint between the outer first side panel and the outer front panel.

FIG. 4 shows the next steps in forming the KDF. The inner first back panel 114*a* and the inner first side panel 114*b* are folded over the inner front panel 114*c* along fold joint 110*b* (see FIG. 1). During the fold, the perforation between the first connection tab 106*b* and the first side bottom flap 122*b* will break, as shown in FIG. 4. Adhesive is then applied to the outer side of the inner first back panel 114*a*, as shown by the striped areas 156. The outer first back panel 112*a* and the outer first side panel 112*b* are then folded inwardly along joint 108*b*, in the direction indicated by the arrow at the left side of FIG. 4, where it is affixed to the inner first back panel 114*a*, as shown in FIG. 5.

Figure 6:
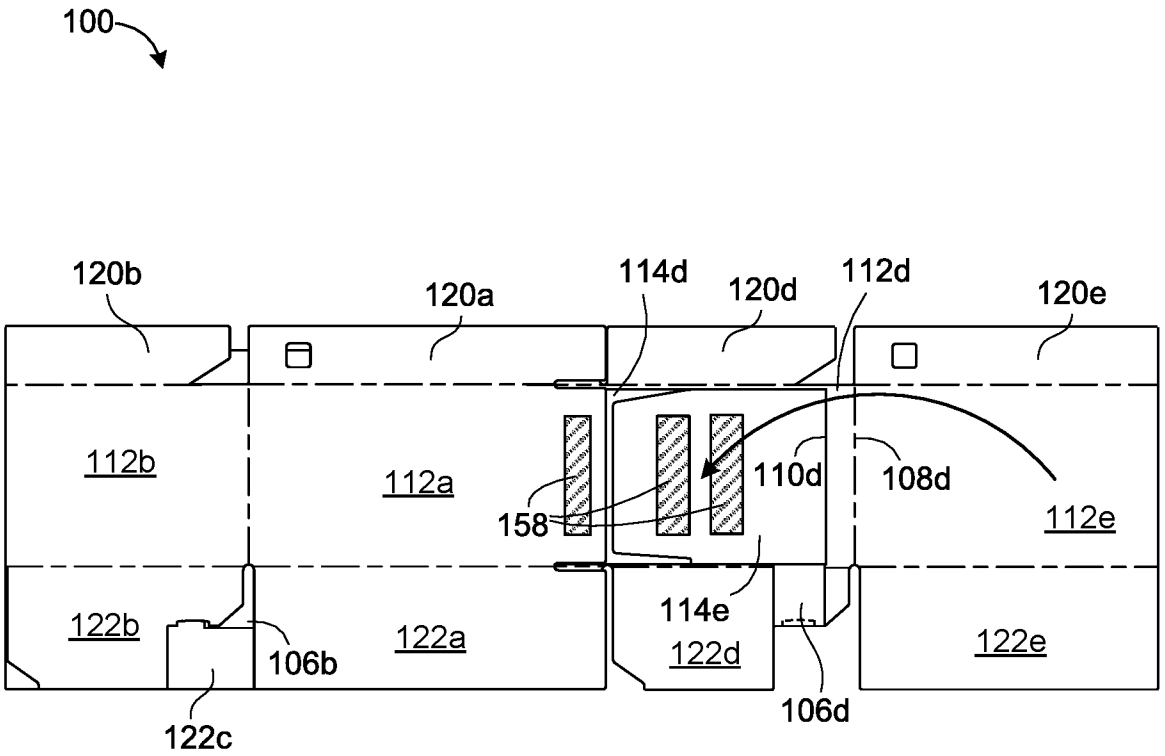
FIG. 6 is a top plan view of the blank of FIG. 1, shown with the inner second back panel folded over the inner second side panel.

Referring to FIG. 6, the inner second back panel 114*e* is folded over the inner second side panel 114*d* along joint 110*d*. Adhesive is then applied to the outer first back panel 112*a* and the inner second back panel 114*e* as shown by the striped areas 158. The outer second back panel 112*e* is then folded along joint 108*d* in the direction of the arrow shown in FIG. 6, which results in the outer second back panel 112*e* becoming affixed to the outer first back panel 112*a* and the inner second back panel 114*e* to form the finished KDF. Once affixed to each other, the outer first back panel 112*a* and the outer second back panel 112*e* combine to form the outer back panel of the container.

Figure 7:
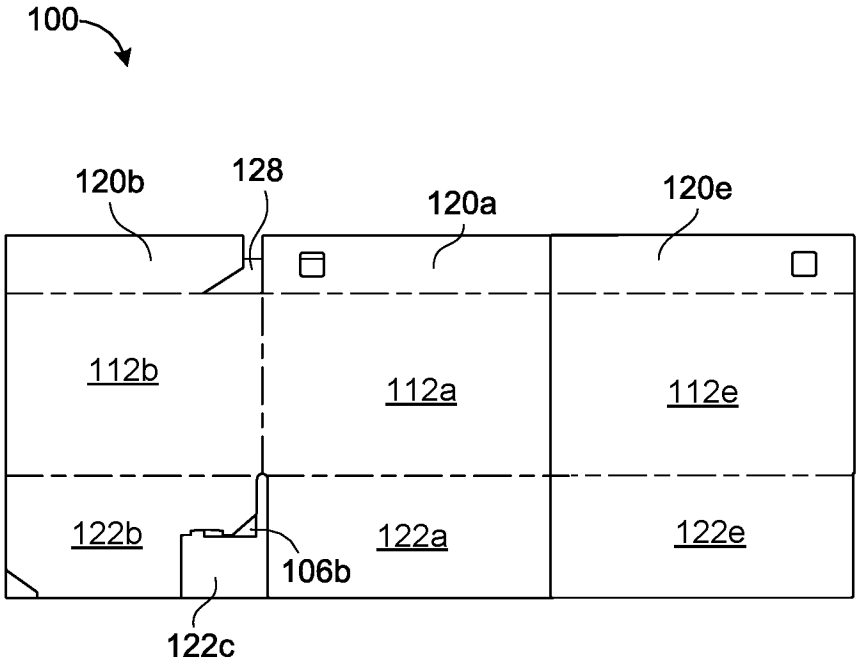
FIG. 7 is a top plan view of the blank of FIG. 1, shown with the outer second back panel folded over the outer and inner second side panels, creating a fully assembled knock-down flat.

The finished KDF of the blank 100 is shown in FIG. 7. The finished KDF can be assembled into a box by squaring the sides to form a box (see FIG. 9). In assembled form, the outer second side panel 112*d* and outer first side panel 112*b* form substantially right angles with the outer front panel 112*c*. It should be noted that the KDF shown in FIG. 7 is a right handed KDF, meaning that the right side (i.e., the second side) of the KDF is lifted to erect the KDF and from an assembled box (see FIG. 9). The same blank 100 can be used to form a left-handed KDF simply be reversing each of the steps performed in FIGS. 4-7 to the opposite side (i.e., each step performed on a left or first side is performed on the right or second side, and vice-versa).

Figure 8:
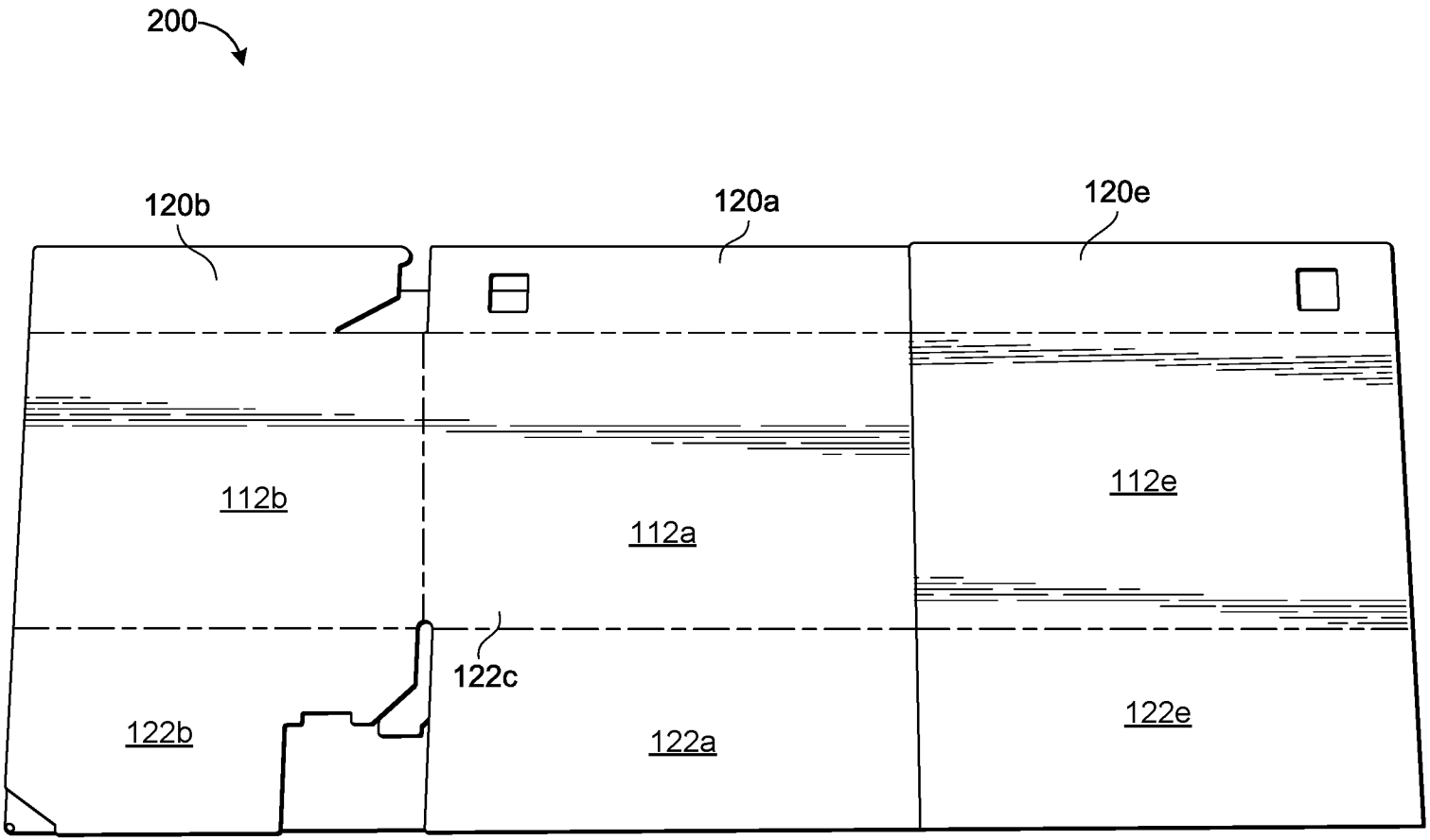
FIG. 8 is a top front perspective view of as a fully assembled knock-down flat constructed from the blank of FIG. 1.

FIG. 8 illustrates a KDF of a container 200 assembled from a blank 100 constructed in accordance with an embodiment of the present invention. The KDF of the container 200 includes many of the same parts and features as those shown in FIGS. 1-7 and are labeled accordingly with corresponding reference numbers advanced by 100.

Figure 9:
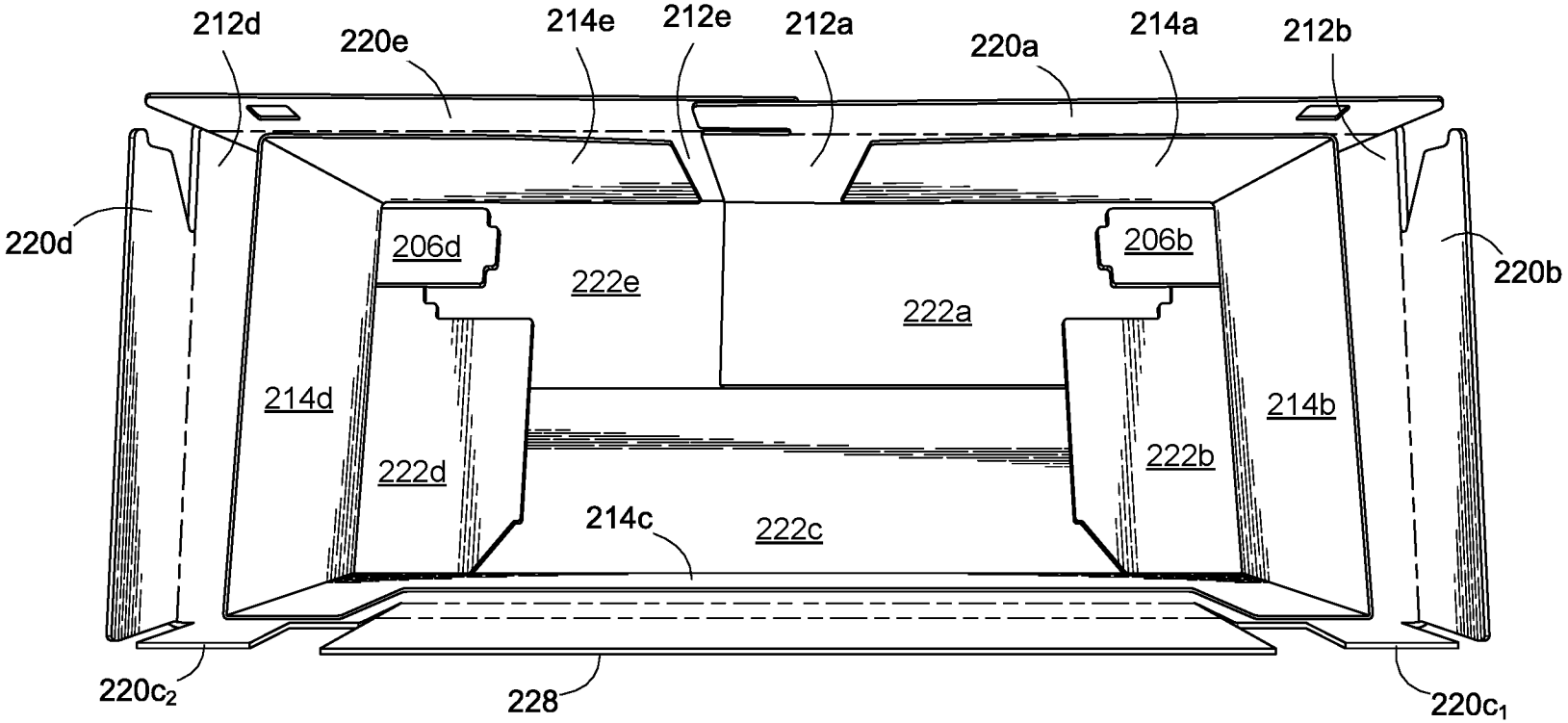
FIG. 9 is a top plan view of an assembled box constructed from the blank of FIG. 1 and erected from the knock-down flat of FIG. 8, with the top flaps in an open position.

FIG. 9 provides an interior view of the assembled container 200. As can be seen in FIG. 9, the first and second inner side panels 214*b*, 214*d* extend from the inner front panel 214*c* to the inner first and second back panels 214*a*, 214*e* in spaced apart relation to the outer first and second side panels 212*b*, 212*d*. In this context, "spaced apart relation" means that the inner first and second side panels 214*b*, 214*d* are spaced apart from (i.e., not in contact with) the outer first and second side panels 212*b*, 212*d* along their entire length. In this embodiment, the inner first and second back panels 214*a*, 214*e* are parallel to the outer first and second side panels 212*b*, 212*d*, respectively. This configuration adds stability to the box, particularly when multiple boxes are stacked upon each other.

Figure 10:
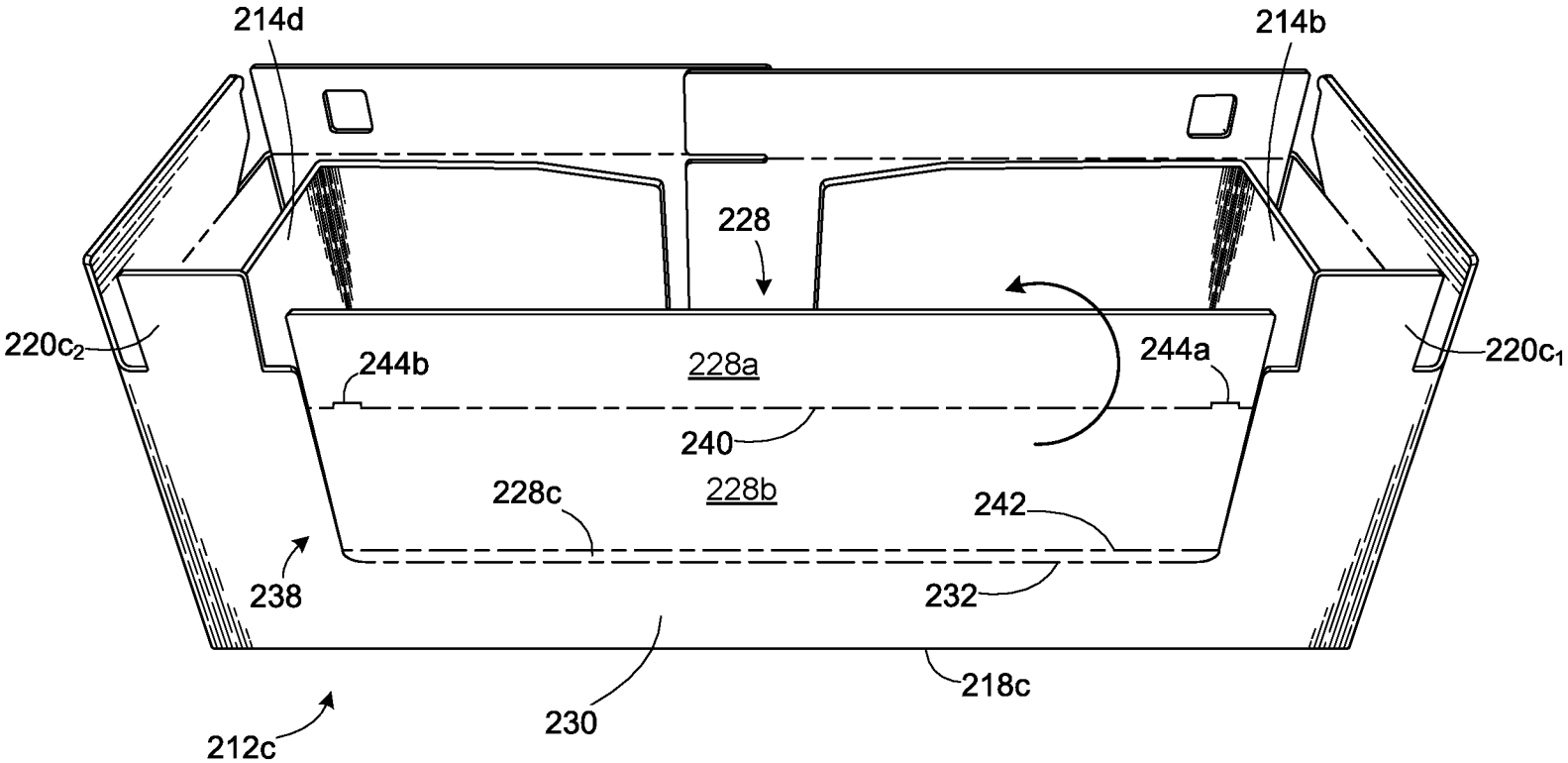
FIG. 10 is a top front perspective view of the assembled box of FIG. 9.
Figure 11:
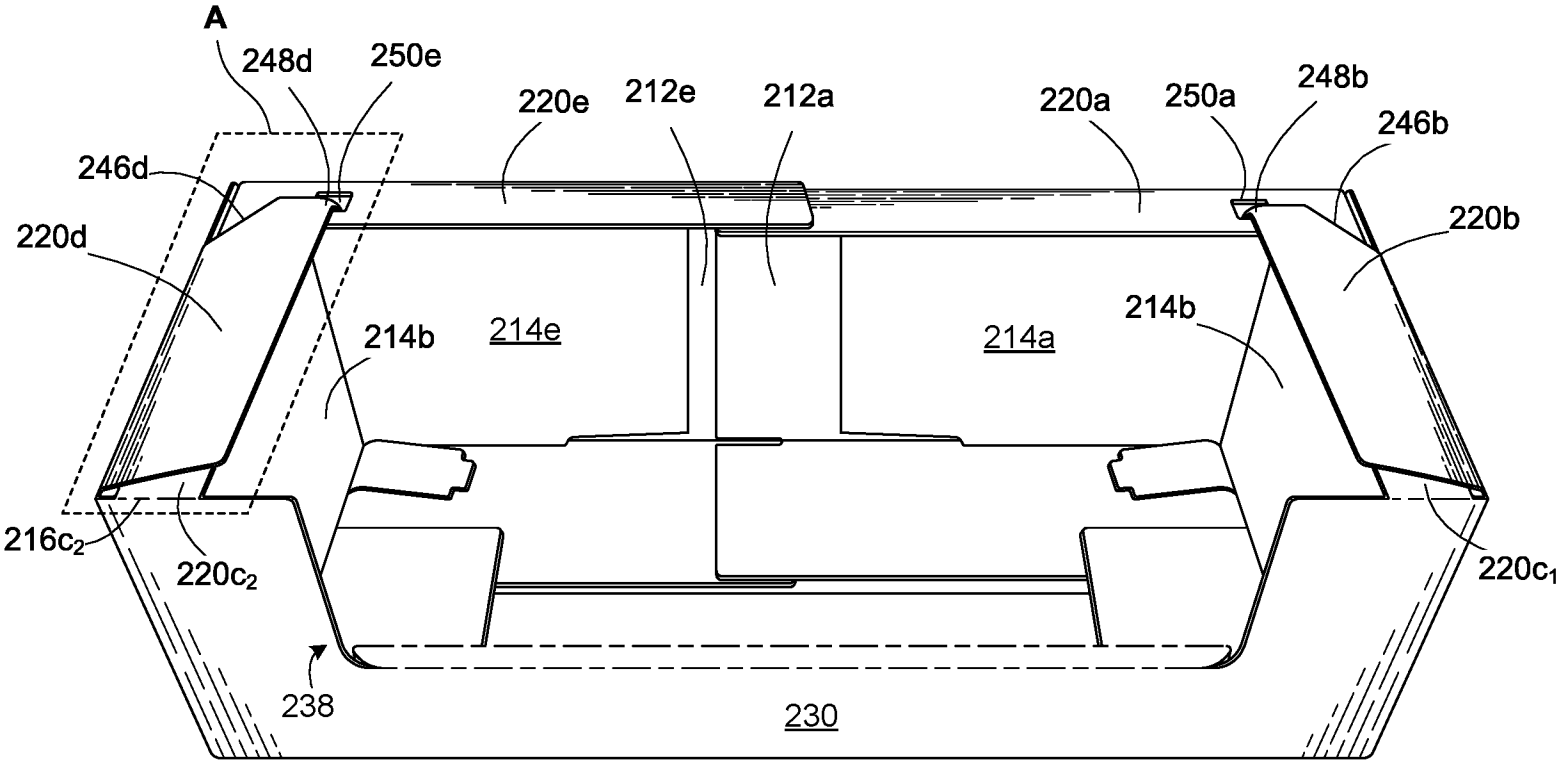
FIG. 11 is a top front perspective view of the assembled box of FIG. 9 with the top flaps folded inwardly and the upper portion of the outer front panel folded inwardly.
Figure 12:
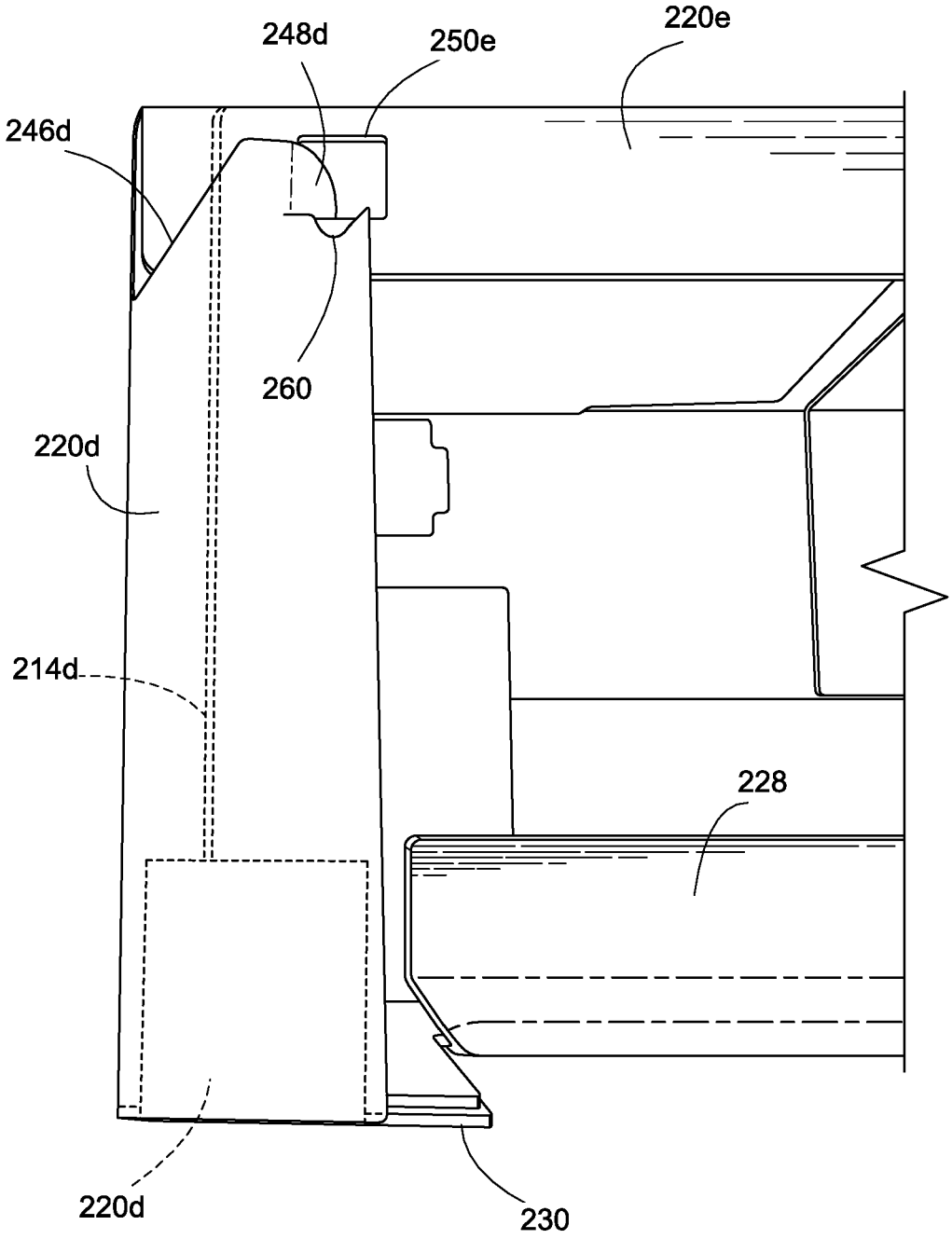
FIG. 12 is an enlarged partial view of the assembled box shown in FIG. 11 and taken at Section A, with the second support tab and the top edge of the inner second side panel shown in phantom.

FIG. 10 shows the assembled container 200 with the upper portion 228 of the outer front panel 212*c* extending upwardly from the front panel fold joint 232. When configuring the container 200 for use, the upper portion 228 is folded inwardly toward the center of the container 200 about the front panel fold joint 232 and the lower fold joint 242 of the upper portion 228 until the inner surface of the upper portion 228 is substantially facing the inner surface of the inner front panel 214*c* (not shown in FIG. 10). The top section 228*a* of the upper portion 228 is also folded outwardly about the upper fold joint 240, thereby exposing the fold-over tabs 244*a*, 244*b*, so that the top section 228*a* abuts the bottom surface of the container 200 (i.e., the front bottom flap 222*c*) while the middle section 228*b* of the upper portion 228 faces the inner surface of the inner front panel 214*c*, as seen in FIGS. 11 and 12. In one embodiment, the fold-over tabs 244*a*, 244*b* are inserted in the crease created in the front bottom flap fold joint 218*c* to frictionally secure the upper portion 228 in a folded-over position. This creates a window defined by the outer window border 238 that allows the contents of the container 200 to be displayed while in a stacked configuration with other such containers.

FIGS. 11 and 12 illustrate the container 200 when the top flaps and tabs 220*a-e* are folded downwardly to create a top surface on which other such containers may be stacked. First, the combined first and second back top flaps 220*a*, 220*e* along with the first and second support tabs 220$c_1$, 220$c_2$ are folded inwardly such that they make contact with the top edges of the inner first and second side panels 214*b*, 214*d*, respectively. The first and second side top flaps 220*b*, 220*d* are then folded inwardly until they contact the first and second back top flaps 220*a*, 220*e* and the first and second support tabs 220$c_1$, 220$c_2$, respectively. The positioning of the first and second back top flaps 220*a*, 220*e* and the first and second support tabs 220$c_1$, 220$c_2$ between the first and second side flaps 220*b*, 220*d* and the top edges of the inner first and second side panels 214*b*, 214*d* allow the first and second back top flaps 220*a*, 220*e* and the first and second support tabs 220$c_1$, 220$c_2$ to provide vertical support for the first and second side flaps 220*b*, 220*d* when a second container is placed on top of the container 200. Such support inhibits the second container from nesting within the interior of the container 200.

The first and second cutaway portions 246*b*, 246*d* of the first and second side top flaps 220*b*, 220*d* allow for the first and second back top flaps 220*a*, 220*e* to provide single layers of corrugated fiberboard as bearing surfaces proximate to the back corners of the container 200. Meanwhile, the bearing surfaces of the container 200 at the top edges of the inner first and second side walls 214*b*, 214*d* proximate to the back corners of the container 200 are supported by double layers of corrugated fiberboard provided by the first and second side top flaps 220*b*, 220*d* and the first and second back top flaps 220*a*, 220*e*, respectively. This arrangement promotes a more even bearing surface near the back corners of the container 200, thus also inhibiting a second container from nesting within the interior of the container 200.

To help secure the first and second side top flaps 220*b*, 220*d* against the first and second back top flaps 220*a*, 220*e*, the first and second tuck flaps 248*b*, 248*d* are fitted within the first and second tuck slots 250*a*, 250*e*. In one embodiment, the first and second tuck flaps 248*b*, 248*d* include tuck slits (see tuck slit 260 in FIG. 12) that enable the first and second tuck flaps 248*b*, 248*d* to be further fit inside the first and second tuck slots 250*a*, 250*e*. In one embodiment the tuck slits are cut such that they create detents in the first and second tuck flaps 248*b*, 248*d* that secure the first and second tuck flaps 248*b*, 248*d* within the first and second tuck slots 250*a*, 250*e*, respectively, thereby securing the first and second side top flaps 220*b*, 220*d* against the first and second back top flaps 220*a*, 220*e*, respectively.

All examples and conditional language recited herein are intended for pedagogical purposes to aid the reader in understanding the principles of the present invention and the concepts contributed by the inventor in furthering the art. As such, they are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It is to be understood that the embodiments described herein are merely exemplary and that a person skilled in the art may make many variations and modifications without departing from the spirit and scope of the invention. All such variations and modifications are intended to be included within the scope of the invention.

We claim:

1. A corrugated fiberboard blank, comprising:

an outer portion comprising:

an outer front panel having a first side edge and a second side edge, an outer first side panel adjacent to the first side edge of the outer front panel and having a front edge and a back edge, an outer second side panel adjacent to the second side edge of the outer front panel and having a front edge and a back edge, an outer first back panel adjacent to the back edge of the outer first side panel, and an outer second back panel adjacent to the back edge of the outer second side panel, wherein the outer front panel, the outer first side panel, the outer second side panel, and at least one of the outer first back panel and the outer second back panel form an enclosed perimeter wall, the outer front panel including a lower portion and an upper portion, the lower portion having an upper border that defines a display window of the outer front panel, and the upper portion being connected to the lower portion along a portion of the upper border;

an inner portion comprising:

an inner front panel having a first side edge and a second side edge, an inner first side panel adjacent to the first side edge of the inner front panel and having a front edge and a back edge, an inner second side panel adjacent to the second side edge of the inner front panel and having a front edge and a back edge, an inner first back panel adjacent to the back edge of the inner first side panel, and an inner second back panel adjacent to the back edge of the inner second side panel;

a first side top flap extending from an upper edge of the outer first side panel;

a second side top flap extending from an upper edge of the outer second side panel;

a first back top flap extending from an upper edge of the first outer back panel;

a second back top flap extending from an upper edge of the second outer back panel;

a front bottom flap extending from a bottom edge of the outer front panel;

a first side bottom flap extending from a bottom edge of the outer first side panel;

a second side bottom flap extending from a lower edge of the outer second side panel;

a first back bottom flap extending from a bottom edge of the outer first back panel; and a second back bottom flap extending from a bottom edge of the outer second back panel;

wherein each of the first and the second side top flaps and the first and the second back top flaps has a top flap height and each of the front bottom flap, the first and the second side bottom flaps, and the first and the second back bottom flaps has a bottom flap height, the top flap height being less than the bottom flap height.

2. The corrugated fiberboard blank of claim 1, further comprising: a first support tab and a second support tab, both extending from an upper edge of the outer front panel, the first support tab being located proximate to the first side top flap and the second support tab being located proximate to the second side top flap.

3. The corrugated fiberboard blank of claim 2, wherein each of the first support tab and the second support tab has a width that is no greater than the top flap height.

4. The corrugated fiberboard blank of claim 1, further comprising: a plurality of connection tabs that connect the inner portion to the outer portion, wherein the inner portion is connected to the outer portion only by the plurality of connection tabs.

5. The corrugated fiberboard blank of claim 4, further comprising: a pivot axis, wherein each of the plurality of the connection tabs is connected to one of the first side bottom flap and the second side bottom flap along the pivot axis.

6. The corrugated fiberboard blank of claim 1, wherein the first side top flap includes a cutaway portion that extends into the first side top flap along the upper edge of the outer first side panel.

7. The corrugated fiberboard blank of claim 1, wherein:

the first side top flap includes a tuck flap, the first back top flap includes a tuck slot, and the tuck flap is sized, shaped, and located to enable the tuck flap to be inserted into the tuck slot when the corrugated fiberboard blank is constructed into a container.

8. The corrugated fiberboard blank of claim 7, wherein the tuck flap of the first side top flap includes a detent that resists separation of the tuck flap from the tuck slot of the first back top flap.

9. The corrugated fiberboard blank of claim 1, wherein the top flap height is less than three-quarters of the bottom flap height.

10. The corrugated fiberboard blank of claim 9, wherein the top flap height is less than half of the bottom flap height.

11. A method of forming a container, comprising:

(a) providing an outer portion comprising an outer front panel, an outer first side panel adjacent to a first side edge of the outer front panel, an outer second side panel adjacent to a second side edge of the outer front panel, and at least one outer back panel adjacent to a back edge of one of the outer first side panel and the outer second side panel;

(b) providing an inner portion comprising an inner front panel, an inner first side panel adjacent to a first side edge of the inner front panel, an inner second side panel adjacent to a second side edge of the inner front panel, an inner first back panel adjacent to a back edge of the inner first side panel, and an inner second back panel adjacent to a back edge of the inner second side panel;

(c) providing a first side top flap extending from an upper edge of the outer first side panel, a second side top flap extending from an upper edge of the outer second side panel, and at least one back top flap extending from an upper edge of the at least one outer back panel; and (d) providing a front bottom flap extending from a bottom edge of the outer front panel, a first side bottom flap extending from a bottom edge of the outer first side panel, a second side bottom flap extending from a lower edge of the outer second side panel, and at least one back bottom flap extending from a bottom edge of the at least one outer back panel;

(e) positioning the inner portion into a position atop the outer portion;

(f) affixing the inner front panel to an inner side of the outer front panel in the position of step (e);

(g) affixing the inner first back panel and the inner second back panel to an inner side of the at least one outer back panel in a location that results in:

the inner first side panel extending from the inner front panel to the inner first back panel in a spaced-apart relationship to the outer first side panel, and the inner second side panel extending from the inner front panel to the inner second back panel in a spaced-apart relationship to the outer second side panel;

(h) forming an enclosed perimeter wall comprising the outer front panel, the outer first side panel, the outer second side panel, and the at least one outer back panel;

(i) forming a substantially enclosed bottom surface from the front bottom flap, the first side bottom flap, the second side bottom flap, and the at least one back bottom flap; and (j) forming a load bearing top surface from the first side top flap, the second side top flap, and the at least one back top flap, the load bearing top surface defining a window through which an interior of the container can be viewed.

12. The method of claim 11, wherein:

each of the first side top flap, the second side top flap, and the at least one back top flap has a top flap height, and each of the front bottom flap, the first side bottom flap, the second side bottom flap, and the at least one back bottom flap has a bottom flap height, wherein the top flap height is less than three-quarters of the bottom flap height.

13. The method of claim 11, wherein:

the outer front panel includes an upper portion and a lower portion, the upper portion and the lower portion being separated by a border that defines an outer window border, and step (e) further comprises positioning the inner portion so that an upper edge of the inner front panel is located below the outer window border.

14. The method of claim 13, wherein:

step (c) further comprises providing a first support tab and a second support tab, both extending from the upper edge of the lower portion of the outer front panel, the first support tab being located proximate to the first side top flap and the second support tab being located proximate to the second side top flap; and step (j) further comprises positioning the first support tab between the first side top flap and an upper edge of the inner first side panel, and positioning the second support tab between the second side top flap and an upper edge of the inner second side panel.

15. The method of claim 14, wherein the first support tab has a width that is no greater than the top flap height, and the second support tab has a width that is no greater than the top flap height.

16. The method of claim 11, wherein step (e) further comprises folding the inner portion along a pivot axis, the pivot axis being located along at least one connection tab between the inner portion and the outer portion, the pivot axis being parallel and located above a lowermost edge of any of the front bottom flap, the first side bottom flap, the second side bottom flap, and the at least one back bottom flap.

17. The method of claim 16, wherein the inner portion is connected to the outer portion solely along the at least one connection tab when step (e) is performed.

18. The method of claim 11, wherein step (j) further comprises folding the first side top flap and the at least one back top flap such that an inner surface of the first side top flap abuts an outer surface of the at least one back top flap.

19. The method of claim 11, wherein the first side top flap includes a tuck flap and the at least one back top flap includes a tuck slot, and step (j) further comprises inserting the tuck flap of the first side top flap into the tuck slot of the at least one back top flap.

20. The method of claim 19, wherein the tuck flap includes a detent for securing the tuck flap within the tuck slot.

* * * * *